US008875546B2

(12) United States Patent
Park

(10) Patent No.: US 8,875,546 B2
(45) **Date of Patent: *Nov. 4, 2014**

(54) COUPLING STRUCTURE OF STEAM GENERATOR IN WASHING DEVICE

(75) Inventor: Seog Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1910 days.

This patent is subject to a terminal disclaimer.

(21) Appl. No.: 11/629,297

(22) PCT Filed: Feb. 27, 2006

(86) PCT No.: PCT/KR2006/000682

§ 371 (c)(1),
(2), (4) Date: Feb. 26, 2009

(87) PCT Pub. No.: WO2006/091054

PCT Pub. Date: Aug. 31, 2006

(65) Prior Publication Data

US 2009/0151400 A1 Jun. 18, 2009

(30) Foreign Application Priority Data

Feb. 28, 2005 (KR) ..... 10-2005-0016982

(51) Int. Cl.

| | |
|---|---|
| ***D06F 37/00*** | (2006.01) |
| ***F22B 1/28*** | (2006.01) |
| ***D06F 39/00*** | (2006.01) |
| ***D06F 39/12*** | (2006.01) |

(52) U.S. Cl.

CPC ..... *D06F 39/008* (2013.01); *F22B 1/284* (2013.01); *D06F 39/12* (2013.01)

USPC ..... 68/5 C

(58) Field of Classification Search

USPC ..... 68/5 R, 5 C; 8/149.3

See application file for complete search history.

(56) References Cited

U.S. PATENT DOCUMENTS

| | | | | |
|---|---|---|---|---|
| 2,172,495 | A * | 9/1939 | Bulpitt | 392/447 |
| 5,020,128 | A * | 5/1991 | Bleckmann | 392/498 |
| 7,490,494 | B2 * | 2/2009 | Kim et al. | 68/15 |
| 2004/0244432 | A1 * | 12/2004 | Kim et al. | 68/5 C |
| 2006/0010937 | A1 * | 1/2006 | Kim et al. | 68/12.05 |

FOREIGN PATENT DOCUMENTS

| | | |
|---|---|---|
| EP | 0 821 096 | 1/1998 |
| EP | 1 464 751 | 10/2004 |
| EP | 1507029 A2 | 2/2005 |
| EP | 1616990 A1 | 1/2006 |

* cited by examiner

*Primary Examiner* — David Cormier

(74) *Attorney, Agent, or Firm* — McKenna Long & Aldridge LLP

(57) ABSTRACT

A steam generator for a washing device is disclosed, in which the power supplied to a heater is cut off before a water level of water used to generate steam is lower than an end of the heater, thereby avoiding a risk of fire. The steam generator includes a case coupled with the main body of the washing device. A heater is provided inside the case. A temperature fuse is provided inside the case when a coupling portion couples the case with the main body of the temperature fuse is configured to be higher than the heater based on a horizontal line.

19 Claims, 10 Drawing Sheets

COUPLING STRUCTURE OF STEAM GENERATOR IN WASHING DEVICE

TECHNICAL FIELD

The present invention relates to a washing device, and more particularly, to a coupling structure of a steam generator in a washing device, in which steam is generated to be used for washing and drying functions.

BACKGROUND ART

In general, examples of a washing device include a pulsator type washing machine, a drum washing machine, a washing machine having a drying function, and a drying machine. The pulsator type washing machine is provided with a drum built in a vertical direction. The drum washing machine is provided with a drum laid in a horizontal direction. The drying machine carries out only a drying function of clothes.

Among the examples of the washing device, the pulsator type washing machine, the drum washing machine, and the washing machine having a drying function have carried out a washing mode using washing water.

However, a problem arises in that a great quantity of washing water is required for the washing mode. In this respect, efforts to minimize the quantity of the washing water used for the washing mode have been recently made.

As a result, a steam generator has been developed. The steam generator serves to assist in carrying out the washing mode using a small number of washing water.

Hereinafter, a related art steam generator for a washing device will be described with reference to the accompanying drawings.

First, as shown in FIG. 1 and FIG. 2, the related art steam generator for a washing device includes a case 1, a heater 2, a water level sensor 3, a temperature sensor 4, and a temperature fuse 5.

The case 1 form a water storage space for storing water required to generate steam while constituting appearance of the steam generator.

At this time, a water supply pipe 1*a* is formed at one side of the case 1. The water supply pipe 1*a* is connected with a water supply path (not shown) of the washing device. A steam discharge pipe 1*b* is formed at the other side of the case 1. The steam discharge pipe 1*b* is connected with a steam supply pipe (not shown) that supplies steam evaporated inside the case 1 into a drum.

The heater 2 is provided on a base inside the case 1 along a horizontal direction. Referring to FIG. 2, the heater 2 is provided in a longitudinal direction by passing through a wall at one side of the case.

At this time, the heater 2 is a sheath heater whose two terminals constituting a start point and an end point are connected with each other to be exposed to any one outer side of the case 1.

The aforementioned heater 2 serves to evaporate water, which is stored in the case 1, due to its heat.

The water level sensor 3 is provided to pass through one side on the case 1.

At this time, the water level sensor 3 serves to sense a water level of the water stored in the case 1.

The temperature fuse 5 is provided at a portion where the terminals of the heater 2 are positioned, that is, one end of the heater 2. The temperature fuse 5 serves to cut off the power supplied to the heater 2 if the heater 2 is overheated.

However, the related art steam generator for a washing device has several problems.

If the water level sensor 3 works in error or does not work due to failure, the heater 2 continues to emit heat even in case that the water stored in the case 1 has been completely evaporated.

In particular, a temperature inside the case 1 rapidly increases due to overheat of the heater 2 as the heater 2 continues to emit heat. For this reason, fire is caused.

In other words, if the heater 2 is overheated, thermal deformation of the case 1 is generated by radiant heat of the heater 2. In this case, a portion of the case 1, where thermal deformation has been generated, is in contact with the heater 2. As a result, fire occurs.

Of course, the heater 2 is provided with the temperature fuse 5 to cut off the power supplied to the heater 2 if the heater 2 is overheated.

However, if the portion of the case, where the temperature fuse 5 is provided, is slanted to be lower than its opposite end, i.e., the other end of the heater 2, the other end of the heater 2 is overheated because the temperature fuse 5 is soaked in water even if it is exposed to the steam. For this reason, a problem arises in that the corresponding portion of the case 1 is thermally deformed to contact the heater 2.

The above problem may arise as the washing device is slanted during its installation even if the steam generator is provided in a horizontal direction with respect to the washing device. This is because that the steam generator fails to maintain a horizontal state with respect to the ground.

DISCLOSURE OF INVENTION

Technical Problem

Accordingly, the present invention is directed to a coupling structure of a steam generator in a washing device, which substantially obviates one or more problems due to limitations and disadvantages of the related art.

Technical Solution

An object of the present invention is to provide a coupling structure of a steam generator in a washing device, in which the power supplied to a heater is cut off before a water level of water used to generate steam is lower than an end of the heater, thereby avoiding a risk of fire.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a coupling structure of a steam generator for a washing device, includes a main body of the washing device; the steam generator including a case constituting appearance, coupled with the main body of the washing device, a heater portion having a heater provided inside the case and terminals provided at one side of the heater, and a temperature fuse provided inside the case; and a coupling portion coupling the case with the main body of the washing device to allow the temperature fuse to be higher than the heater based on a horizontal line.

The coupling portion may be provided between the main body of the washing device and the case of the steam generator. The case of the steam generator has a rectangular box shape and its both sides are narrower than its front and rear surfaces.

Further, the heater may be provided inside the case along a longitudinal direction, the terminals may be formed at one side of the heater and fixed to any one side of the case, and the temperature fuse may be provided toward the terminals. The coupling portion may be provided between any one side the main body constituting the washing device and any other side of the case constituting the steam generator.

Meanwhile, the coupling portion includes a pair of first coupling projections respectively projected at both sides of the other side of the case and coupled with the main body of the washing device. The first coupling projections coupled with the main body have ends downwardly slanted. The first coupling projections may respectively be provided at different heights based on a horizontal direction. The first coupling projections can respectively be provided at opposite angles at the other side of the case.

In another embodiment of the present invention, the coupling portion may be provided between one side of the main body constituting the washing device and the front or rear surface of the case constituting the steam generator. In this case, the coupling portion includes a pair of second coupling projections respectively projected at both sides of the front or rear surface of the case and coupled with the main body of the washing device. The coupling portion between any one of the second coupling projections, which is provided to relatively adjoin the temperature fuse, and the main body is higher than the coupling portion between the other of the second coupling portions and the main body.

In another embodiment of the present invention, the coupling portion is respectively provided between one side of the main body constituting the washing device and any other side of the case and between the other side of the main body adjacent to the one side of the main body and the front or rear surface of the case constituting the steam generator.

The coupling portion includes a pair of first coupling projections respectively projected at both sides on the other side of the case and coupled with one side of the main body, and a pair of second coupling projections respectively projected at both sides of the front or rear surface of the case and coupled with the other side of the main body adjacent to the one side of the main body.

Meanwhile, it is preferable that the temperature fuse has a height difference from the heater in the range more than a thickness of the heater of the steam generator.

It is to be understood that both the foregoing general description and the following detailed description of the present invention are exemplary and explanatory and are intended to provide further explanation of the invention as claimed.

Advantageous Effects

As described above, the coupling structure of the steam generator according to the present invention has the following advantages.

First, since the portion of the steam generator, where the temperature fuse is positioned, is higher than the height of the heater, it is possible to avoid a risk of fire of the steam generator, which may be caused by overheat of the heater.

In addition, even though the heater or the washing device is slanted toward any one side during the manufacture of the steam generator, the slanted portion can sufficiently be compensated to prevent the heater from being overheated.

It will be apparent to those skilled in the art that various modifications and variations can be made in the present. invention without departing from the spirit or scope of the inventions. Thus, it is intended that the present invention covers the modifications and variations of this invention provided they come within the scope of the appended claims and their equivalents.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
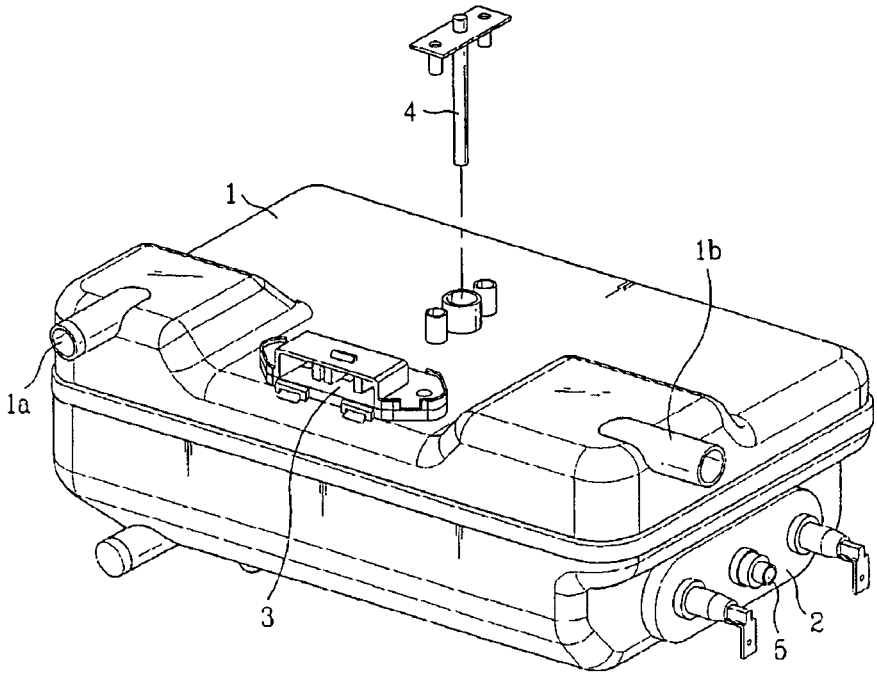
FIG. 1 is a perspective view illustrating a related art steam generator for a washing device.
Figure 2:
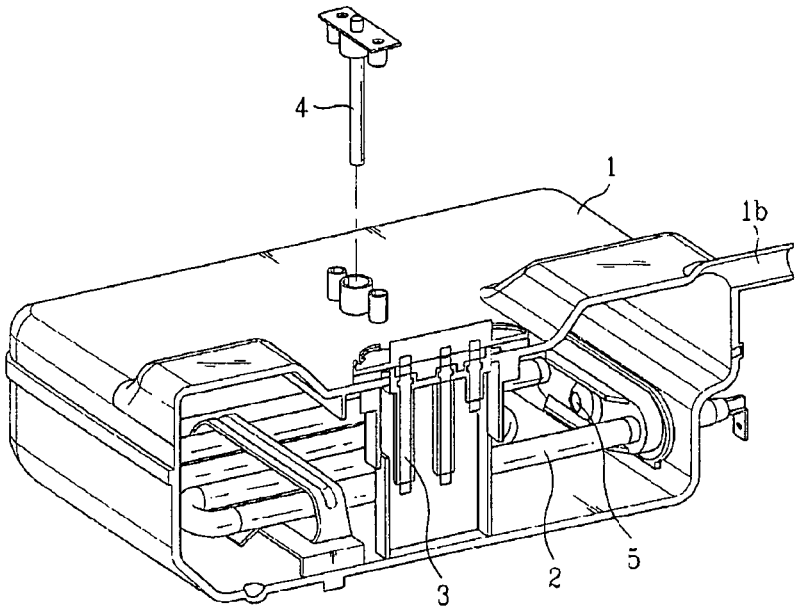
FIG. 2 is a cut perspective view illustrating an inner structure of a related art steam generator for a washing device.
Figure 3:
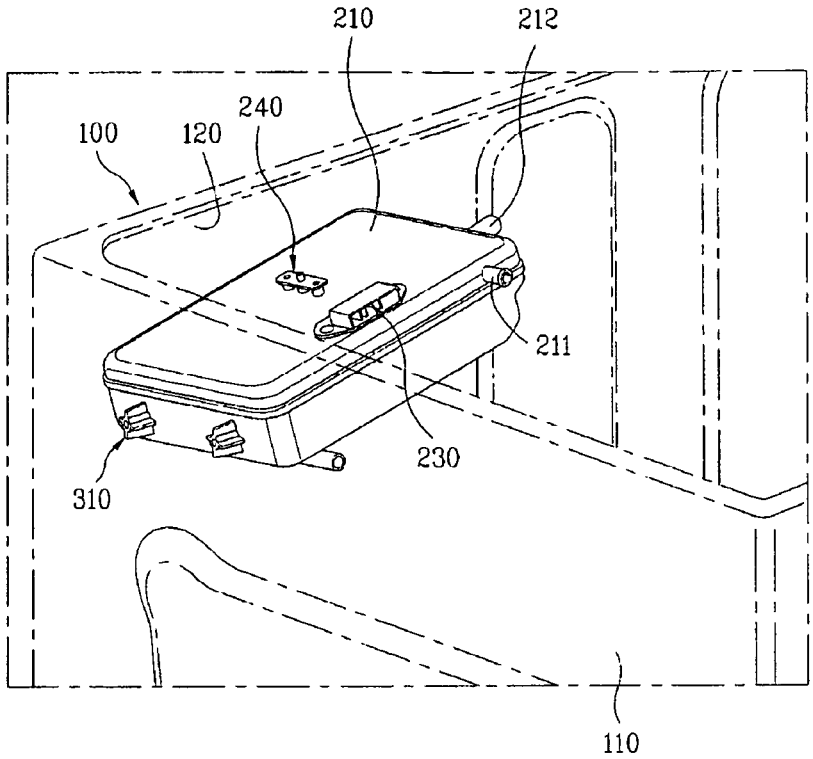
FIG. 3 is a perspective view illustrating a coupling structure of a steam generator for a washing device according to the first embodiment of the present invention.
Figure 4:
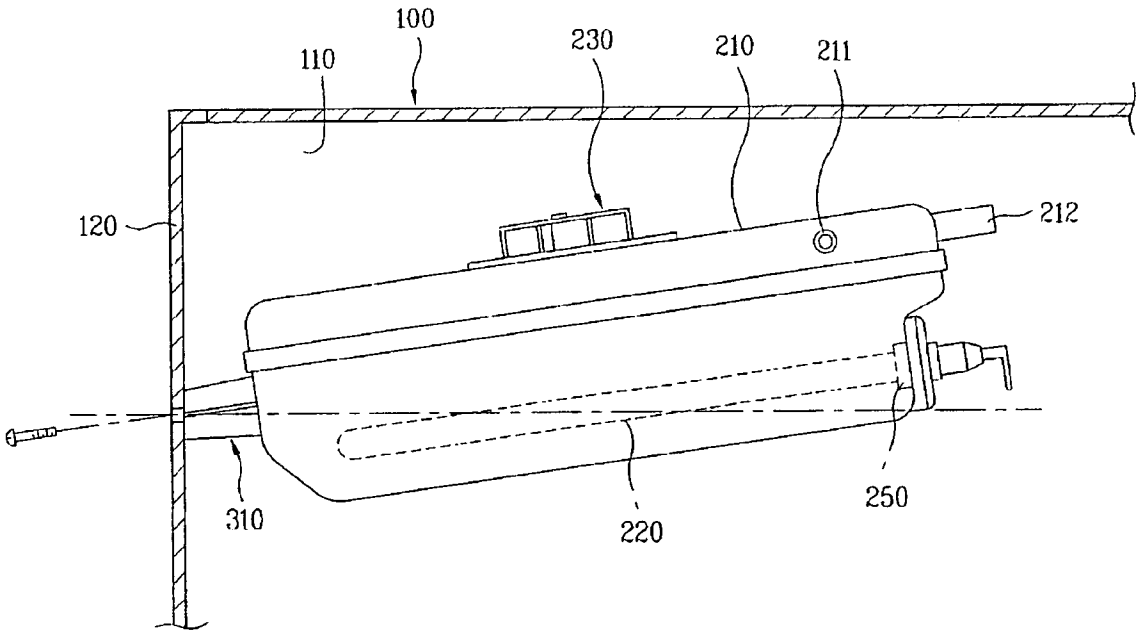
FIG. 4 is a state view illustrating a coupling structure of a steam generator for a washing device according to the first embodiment of the present invention.

FIG. 3 and FIG. 4 illustrate a coupling structure of a steam generator for a washing device according to the first embodiment of the present invention.

As shown in FIG. 3 and FIG. 4, the coupling structure of the steam generator for the washing device according to the, first embodiment of the present invention includes a coupling portion provided between a main body 100 constituting appearance of the washing device and the steam generator.

The main body 100 of the washing device includes a back cover 110 constituting a rear surface, and a side cabinet 120 constituting both sides.

The steam generator includes a case 210, a heater 220, and a temperature fuse 250.

The case 210 constitutes appearance of the steam generator and is provided inside the main body 100 of the washing device. The case 210 has a rectangular box shape.

A water supply pipe 211 is formed at one side of the case 210. The water supply pipe 211 is supplied with water for generating steam. A steam discharge pipe 212 is formed at the other side of the case 210. The steam evaporated inside the case 210 is discharged through the steam discharge pipe 212.

The heater 220 is provided on a base inside the case 210 along a longitudinal direction and in parallel with the case 210.

In particular, as shown in FIG. 4, the heater 220 is longitudinally formed in such a manner that a portion constituting terminals are arranged at one side of the circumference of the case 210 and the other portion reaches the other side of the circumference of the case 210.

Preferably, both sides of the case 210 are narrower than a front surface or a rear surface if the case 210 has a rectangular box shape. This is to allow the heater to be longitudinally inserted into the case.

Therefore, in the present invention, a narrow portion of the case is referred to as the sides, a wide portion is referred to as the front surface, and a portion opposite to the front surface is referred to as the rear surface.

The heater 220 is comprised of a sheath heater.

The temperature fuse 250 is provided to adjoin the sides where the terminals of the heater 220 are positioned, that is, the rear surface of the case 210. The temperature fuse 250 serves to cut off the power supplied to the heater 220 if the heater 220 is overheated.

The coupling portion is provided between the main body 100 of the washing device and the case 210 of the steam generator. The coupling portion is formed to couple the case 210 with the main body 100, so that any one side of the case 210, where adjoins the temperature fuse 250, is higher than the other side.

At this time, the height difference between any one side of the case 210 and the other side thereof is preferably in the range more than the thickness of the heater 220. This is to allow the temperature fuse 250 to be exposed before one end of the heater 220 is exposed, wherein the temperature fuse 250 is positioned at the other end of the heater 220.

More preferably, the height difference is made in the range that the portion of the temperature fuse 250 is completely exposed before the end of the heater 220 is exposed, as shown in the drawings according to the respective embodiments of the present invention.

The coupling portion is provided between the rear surface of the main body 100 constituting the washing device, that is, an inner wall of the back cover 110 and the rear surface of the case 210 of the steam generator. The coupling portion includes a pair of first coupling projections 310.

Since the steam generator can be coupled with the rear surface, both sides and the front surface of the main body 100 of the washing device, one side of the washing device may be defined as the rear surface, both sides and the front surface of the main body 100.

At this time, the first coupling projections 310 are respectively projected at both sides of the rear surface of the case 210 and coupled with the inner wall of the back cover 110. The first coupling projections 310 may be coupled with the inner wall of the back cover 110 by various methods. In the embodiment of the present invention, the first coupling projections 310 are coupled with the inner wall of the back cover 110 by a screw.

In particular, the ends of the first coupling projections 310 coupled with the back cover 110 are slanted toward their base so that they are to be gradually projected toward the inner wall of the back cover 110.

The first coupling projections 310 are provided in such a manner that if their ends are closely adhered to the inner wall of the back cover 110, the rear surface of the case 210 is naturally lowered to allow the portion of the temperature fuse 250 inside the case 210 to be higher than its opposite portion.

In addition, since the inner wall of the back cover 110 can be closely adhered to the ends of the first coupling projections 310, it is possible to obtain stable coupling between the inner wall of the back cover 110 and the first coupling projections 310.

Furthermore, it is preferable that the first coupling projections 310 according to the first embodiment of the present invention are respectively provided at different heights based on a horizontal direction.

This is to maintain a structure that the case 210 is stably coupled with the back cover 110.

In particular, it is most preferable that the first coupling projections 310 are respectively provided at opposite angles on the rear surface of the case 210.

Meanwhile, it is preferable that the steam generator according to the first embodiment of the present invention further includes a water level sensor 230 and a temperature sensor 240.

The water level sensor 230 is provided to pass through one side on the case 210, and serves to sense a water level of water stored in the case 210.

Further, the temperature sensor 240 serves to sense a temperature inside the case 210.

Even though a sensing error occurs in the temperature sensor 240 due to the aforementioned coupling structure of the steam generator according to the first embodiment of the present invention, the procedure of preventing overheat of the heater 220 from occurring will now be described in detail.

First, if the power is supplied to the heater 220 in a state that the water for generating steam is stored in the case 210 constituting the steam generator, the heater 220 starts to emit heat and the water stored in the case 210 is evaporated.

At this time, the steam of the evaporated state is discharged through the steam discharge pipe 212 formed in the case 210.

The water level sensor 230 continues to sense a water level of the water stored in the case 210 while the steam is being generated. As a result, if the sensed water level is higher than a previously set water level, the water level sensor 230 controls the heater 220 so that the heater 220 continues to emit heat. On the other hand, if the sensed water level is lower than the previously set water level, the water level sensor 230 controls the heater 220 so that the power supplied to the heater 220 is cut off.

However, if the water level sensor 230 works in error or gets out of order due to damage, the heater 220 continues to emit heat even though the water level of the water stored in the case 210 becomes lower than the height of the heater 220. For this reason, the temperature inside the case 210 increases rapidly.

However, in the coupling structure of the steam generator for the washing device according to the first embodiment of the present invention, if the water level sensor 230 works in error or does not work, the portion where the temperature fuse 250 is positioned is first exposed. For this reason, a temperature increases rapidly in the corresponding portion of the temperature fuse 250. In this case, wires are down in the temperature fuse 250 and the power supplied to the heater 220 is cut off.

Therefore, the inside of the case 210 can be prevented from being overheated.

Meanwhile, the coupling structure of the steam generator according to the present invention is not limited to that according to the first embodiment of the present invention.

In other words, the coupling structure of the steam generator according to the present invention should be made considering the coupling portion between the case 210 and the main body 100 constituting the washing device.

Mode For The Invention

The preferred coupling structures of the steam generator according to the second to fifth embodiments of the present invention will be described based on the coupling portion between the case 210 and the main body 100.

Figure 5:
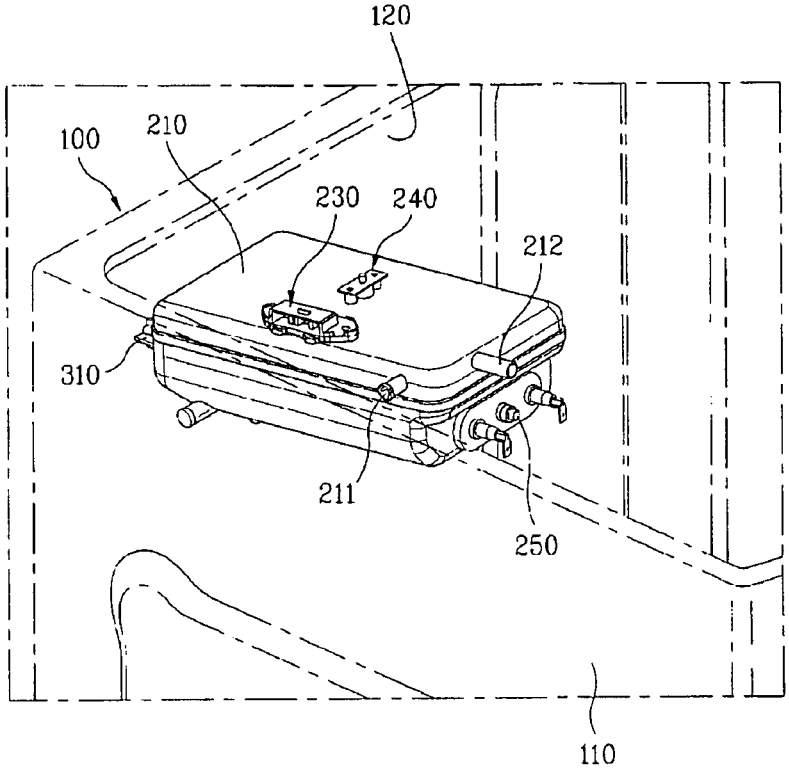
FIG. 5 is a perspective view illustrating a coupling structure of a steam generator for a washing device according to the second embodiment of the present invention.
Figure 6:
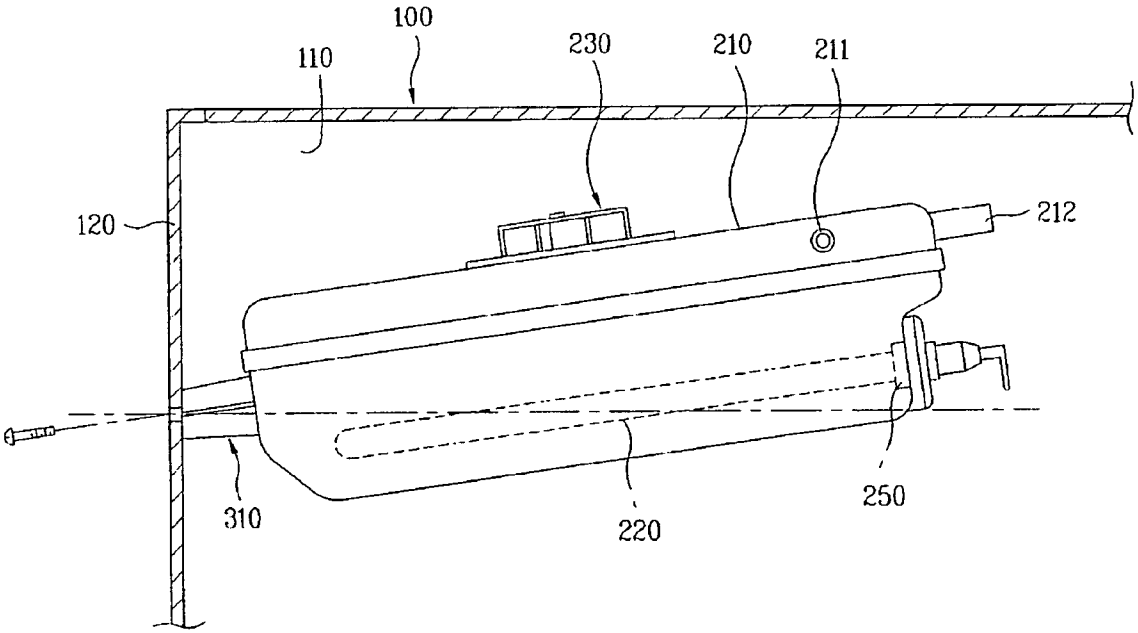
FIG. 6 is a state view illustrating a coupling structure of a steam generator for a washing device according to the second embodiment of the present invention.

First, FIG. 5 and FIG. 6 illustrate the coupling structure of the steam generator for the washing device according to the second embodiment of the present invention.

The coupling portion of the steam generator according to the second embodiment of the present invention is provided between the rear surface of the case 210 and the inner wall of the side cabinet 120 of the main body 100 constituting the washing device.

In this case, the coupling portion of the steam generator according to the second embodiment of the present invention has the same shape as that of the coupling portion of the steam generator according to the first embodiment of the present invention.

In other words, the coupling portion includes a pair of first coupling projections 310 respectively projected at both sides on the rear surface of the case 210. Ends of the first coupling projections 310 coupled with the inner wall of the side cabinet 120 are slanted toward their base so that they are to be gradually projected toward the inner wall of the side cabinet 120.

At this time, it is preferable that the first coupling projections 310 are provided at different heights based on a horizontal direction in the same manner as the coupling structure according to the first embodiment of the present invention. In particular, it is most preferable that the first coupling projections 310 are respectively provided at opposite angles on the rear surface of the case 210.

Therefore, if the steam generator is coupled into the main body 100 as shown in FIG. 6, the rear surface of the case 210, where the temperature fuse 250 is positioned, is naturally lowered.

In this case, even though the water level sensor 230 and/or the temperature sensor 240 works in error or does not work, the water level of the portion where the temperature fuse 250 is positioned is first lowered. As a result, the temperature fuse 250 is first exposed and thus the heater 220 can be prevented from being overheated.

Figure 7:
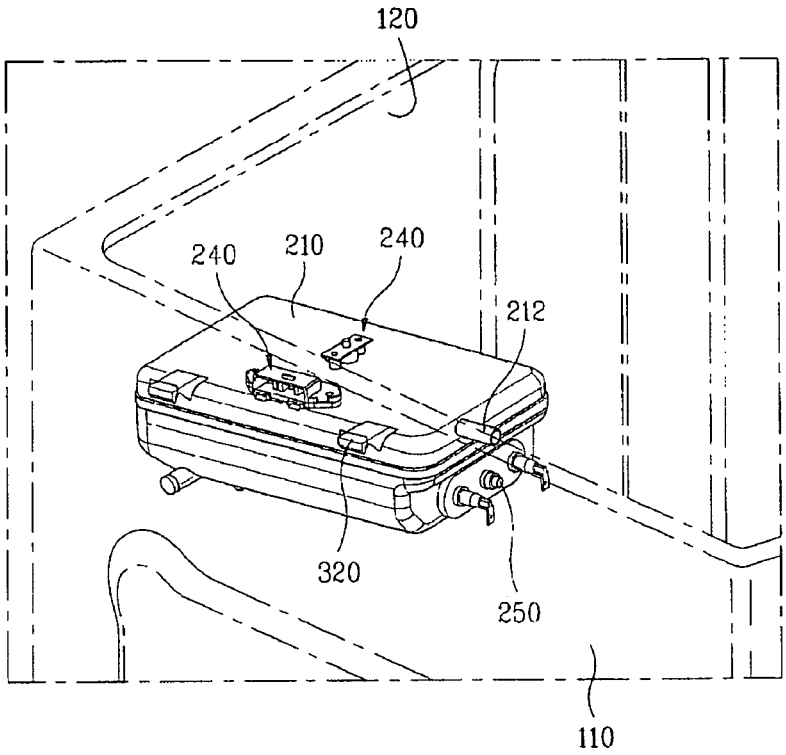
FIG. 7 is a perspective view illustrating a coupling structure of a steam generator for a washing device according to the third embodiment of the present invention.
Figure 8:
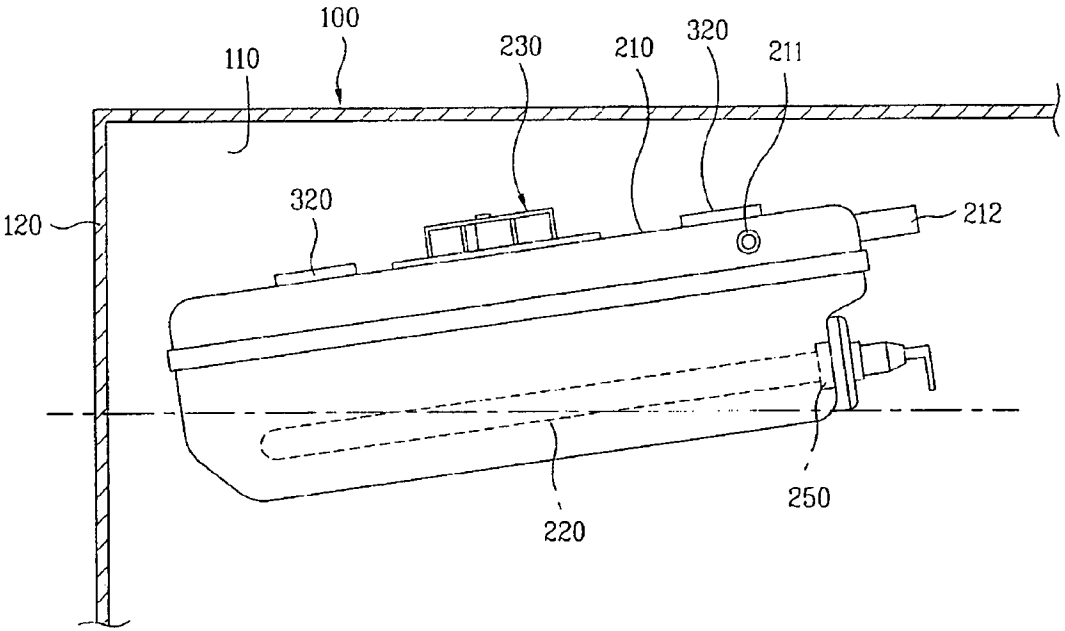
FIG. 8 is a state view illustrating a coupling structure of a steam generator for a washing device according to the third embodiment of the present invention.

Meanwhile, FIG. 7 and FIG. 8 illustrate the coupling structure of the steam generator for the washing device according to the third embodiment of the present invention.

The coupling portion of the steam generator according to the third embodiment of the present invention is provided between any one long side (hereinafter, referred to as "case side") of the circumference of the case 210 constituting the steam generator and the inner wall of the back cover 110 of the main body 100 constituting the washing device.

In particular, the coupling portion of the steam generator according to the third embodiment of the present invention includes a pair of second coupling projections 320 respectively projected at both sides of the case 210 and coupled with the inner wall of the back cover 110.

At this time, the coupling portion between any one of the second coupling projections 320, which is provided to relatively adjoin the temperature fuse 250, and the inner wall of the back cover 110 is higher than the coupling portion between the other of the second coupling portions 320 and the inner wall of the back cover 110.

Therefore, if the steam generator is coupled into the main body 100 as shown in FIG. 8, the portion of the case 210, where the temperature fuse 250 is positioned, is naturally lowered.

In this case, even though the water level sensor 230 and/or the temperature sensor 240 works in error or does not work, the water level of the portion where the temperature fuse 250 is positioned is first lowered. As a result, the temperature fuse 250 is first exposed and thus the heater 220 can be prevented from being overheated.

Figure 9:
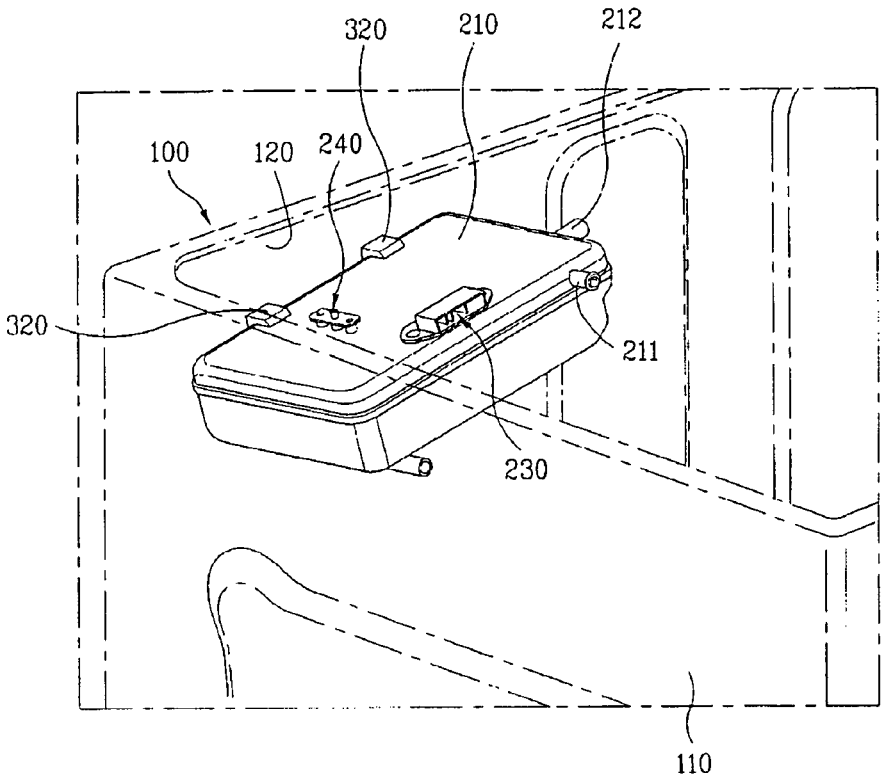
FIG. 9 is a perspective view illustrating a coupling structure of a steam generator for a washing device according to the fourth embodiment of the present invention.
Figure 10:
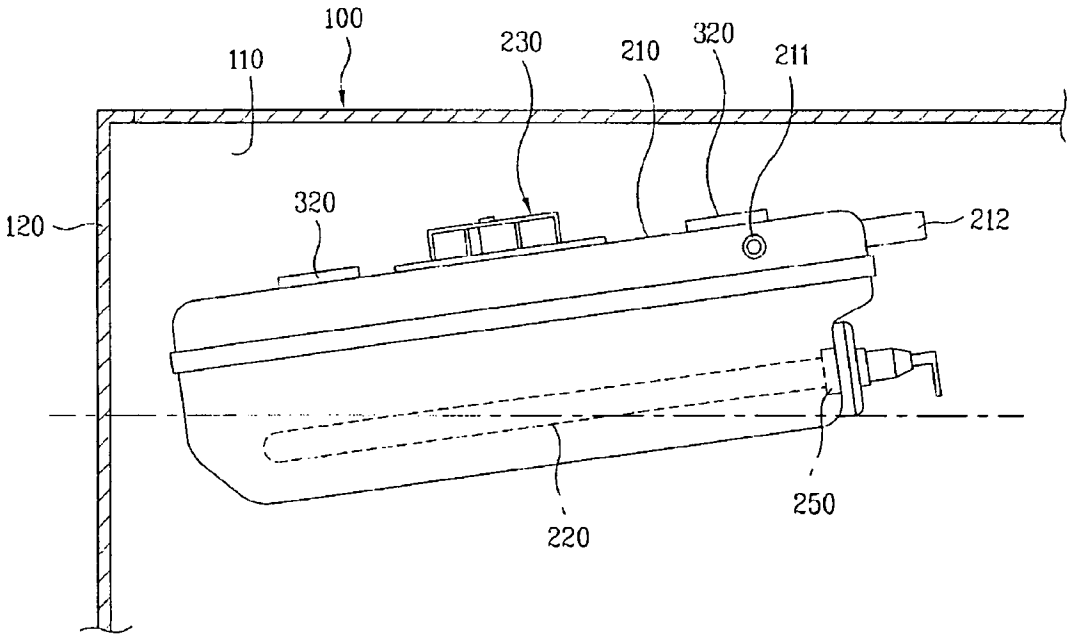
FIG. 10 is a state view illustrating a coupling structure of a steam generator for a washing device according to the fourth embodiment of the present invention.

Meanwhile, FIG. 9 and FIG. 10 illustrate the coupling structure of the steam generator for the washing device according to the fourth embodiment of the present invention.

The coupling portion of the steam generator according to the fourth embodiment of the present invention is provided between any one long side (hereinafter, referred to as "case side") of the circumference of the case 210 constituting the steam generator and the inner wall of the side cabinet 120 of the main body 100 constituting the washing device.

In particular, the coupling portion of the steam generator according to the fourth embodiment of the present invention includes a pair of second coupling projections 320 respectively projected at both sides of the case 210 and coupled with the inner wall of the side cabinet 120.

At this time, the coupling portion between any one of the second coupling projections 320, which is provided to relatively adjoin the temperature fuse 250, and the inner wall of the side cabinet 120 is higher than the coupling portion between the other one of the second coupling portions 320 and the inner wall of the side cabinet 120.

Therefore, if the steam generator is coupled into the main body 100 as shown in FIG. 10, the portion of the case 210, where the temperature fuse 250 is positioned, is naturally lowered.

In this case, even though the water level sensor 230 and/or the temperature sensor 240 works in error or does not work, the water level of the portion where the temperature fuse 250 is positioned is first lowered. As a result, the temperature fuse 250 is first exposed and thus the heater 220 can be prevented from being overheated.

Figure 11:
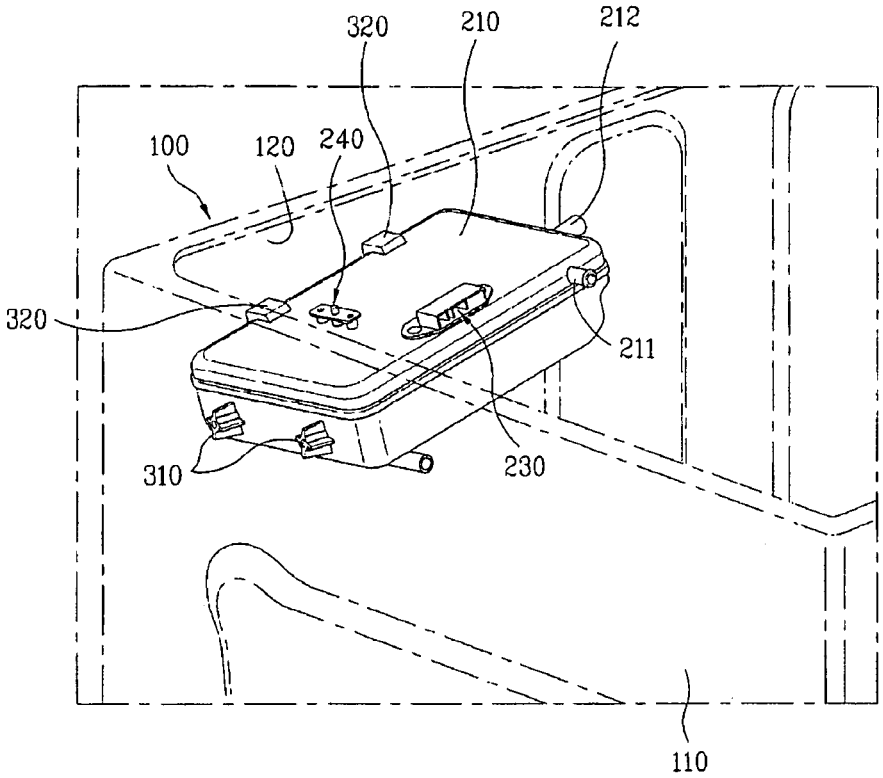
FIG. 11 is a perspective view illustrating a coupling structure of a steam generator for a washing device according to the fifth embodiment of the present invention.

Meanwhile, FIG. 11 illustrates the coupling structure of the steam generator for the washing device according to the fifth embodiment of the present invention.

The coupling portion of the steam generator according to the fifth embodiment of the present invention is respectively provided between the inner wall of the back cover 110 of the main body 100 constituting the washing device and the rear surface of the case 210 constituting the steam generator and between the inner wall of the side cabinet 120 of the main body 100 and any one long side (hereinafter, referred to as "case side") of the circumference of the case 210.

At this time, the coupling portion of the steam generator according to the fifth embodiment of the present invention includes a pair of first coupling projections 310 respectively projected at both sides on the rear surface of the case 210 and coupled with the inner wall of the back cover 110, and a pair of second coupling projections 320 respectively projected at both sides of the case 210 and coupled with the inner wall of the side cabinet 120.

In particular, the ends of the first coupling projections 310 coupled with the inner wall of the back cover 110 are slanted toward their base so that they are to be gradually projected toward the inner wall of the back cover 110.

At this time, it is preferable that the first coupling projections 310 according to the fifth embodiment of the present invention are provided at different heights based on a horizontal direction in the same manner as those according to the first embodiment of the present invention. In particular, it is most preferable that the first coupling projections 310 are respectively provided at opposite angles on the rear surface of the case 210.

Furthermore, the coupling portion between any one of the second coupling projections 320, which is provided to relatively adjoin the temperature fuse 250, and the inner wall of the side cabinet 120 is higher than the coupling portion between the other one of the second coupling portions 320 and the inner wall of the side cabinet 120.

Therefore, if the steam generator is coupled into the main body 100, the portion of the case 210, where the temperature fuse 250 is positioned, is naturally lowered.

In this case, even though the water level sensor 230 and/or the temperature sensor 240 works in error or does not work, the water level of the portion where the temperature fuse 250 is positioned is first lowered. As a result, the temperature fuse 250 is first exposed and thus the heater 220 can be prevented from being overheated.

Figure 12:
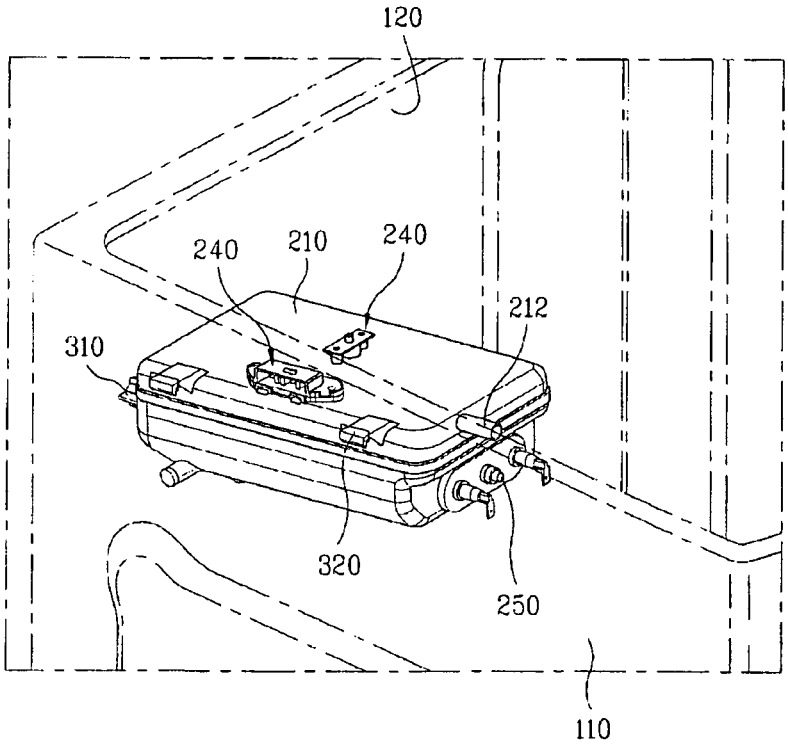
FIG. 12 is a perspective view illustrating a coupling structure of a steam generator for a washing device according to the sixth embodiment of the present invention.

Meanwhile, FIG. 12 illustrates the coupling structure of the steam generator for the washing device according to the sixth embodiment of the present invention.

The coupling portion of the steam generator according to the sixth embodiment of the present invention is respectively provided between the inner wall of the side cabinet 120 of the main body 100 constituting the washing device and the rear surface of the case 210 constituting the steam generator and between the inner wall of the back cover 110 of the main body 100 and any one long side (hereinafter, referred to as "case side") of the circumference of the case 210.

At this time, the coupling portion of the steam generator according to the sixth embodiment of the present invention includes a pair of first coupling projections 310 respectively projected at both sides on the rear surface of the case 210 and coupled with the inner wall of the side cabinet 120, and a pair of second coupling projections 320 respectively projected at both sides of the case 210 and coupled with the inner wall of the back cover 110.

In particular, the ends of the first coupling projections 310 coupled with the inner wall of the side cabinet 120 are slanted toward their base so that they are to be gradually projected toward the inner wall of the side cabinet 120.

At this time, it is preferable that the first coupling projections 310 according to the sixth embodiment of the present invention are provided at different heights based on a horizontal direction in the same manner as those according to the first embodiment of the present invention. In particular, it is most preferable that the first coupling projections 310 are respectively provided at opposite angles on the rear surface of the case 210.

Furthermore, the coupling portion between any one of the second coupling projections 320, which is provided to relatively adjoin the temperature fuse 250, and the inner wall of the back cover 110 is higher than the coupling portion between the other one of the second coupling portions 320 and the inner wall of the back cover 110.

Therefore, if the steam generator is coupled into the main body 100, the portion of the case 210, where the temperature fuse 250 is positioned, is naturally lowered.

In this case, even though the water level sensor 230 and/or the temperature sensor 240 works in error or does not work, the water level of the portion where the temperature fuse 250 is positioned is first lowered. As a result, the temperature fuse 250 is first exposed and thus the heater 220 can be prevented from being overheated.

Meanwhile, in the aforementioned embodiments of the present invention, the coupling structure between each of the coupling projections 310 and 320 and the back cover 110 or the side cabinet 120 of the main body 100 is not limited to a screw coupling structure.

In other words, the second coupling projections 320 of the coupling projections 310 and 320 may be formed to have a hook shape while coupling holes 111 and 121 may be formed in the back cover 110 or the side cabinet 120 of the main body 100 coupled with the second coupling projections 320.

For example, a pair of coupling holes 121 are respectively formed at the front and rear sides of the side cabinet 120 of the main body 100 constituting the washing device. The height of the coupling hole 121 formed at the front of the side cabinet 120 is higher than the height of the coupling hole 121 formed at the rear of the side cabinet 120. Also, it is preferable that the second coupling projections 320 are respectively provided at the front and rear sides parallel with each other among the sides of the case 210 constituting the steam generator.

The invention claimed is:

1. A washing device comprising:

a main body of the washing device;

a steam generator including a case, a heater provided to the case and a temperature fuse provided inside the case; and a coupling portion to couple the case with the main body, wherein the coupling portion includes at least two coupling projections respectively projected from at least one side of the case to be coupled with the main body, thereby the steam generator is coupled at an angle to the main body, and wherein the at least two coupling projections extend from the case in a first direction and terminate in distal end surfaces respectively, which are slanted at a non-perpendicular angle with respect to the first direction such that the steam generator and the first direction are angled with respect to a horizontal line, such that when the case is coupled to the main body, the temperature fuse is placed higher than an end of the heater based on the horizontal line.

2. The steam generator for the washing device as claimed in claim 1, wherein the case has a rectangular box shape and its both sides are narrower than its front and rear surfaces.

3. The steam generator for washing device as claimed in claim 1, wherein the heater is provided inside the case at least one terminal is formed at one side of the heater and fixed to any one side of the case, and the temperature fuse is provided towards the terminal.

4. The steam generator for washing device as claimed in claim 1, wherein the coupling projections are respectively provided at different heights based on a horizontal direction.

5. The steam generator washing device as claimed in claim 3, wherein the coupling portion is provided on a front or rear surface of the case.

6. The steam generator for washing device as claimed in claim 5, wherein the coupling portion includes at least two coupling projections respectively projected from the front or rear surface of the case.

7. The steam generator for a washing device as claimed in claim 1, wherein the temperature fuse has a height difference between the temperature fuse and the end of the heater is in the range more than a thickness of the heater of the steam generator.

8. A washing device, comprising:

a main body of the washing device;

a steam generator including a case, a heater provided inside the case and at least one terminal provided at one side of the heater, and a temperature fuse provided inside the case; and a coupling portion configured to mount the case inside the main body such that the temperature fuse is placed higher than an end of the heater based on a horizontal line, wherein the coupling portion includes a pair of coupling projections respectively at both sides of the case to be coupled with an inner wall of the main body, thereby the steam generator is coupled at an angle to the main body, and wherein one of the coupling projection provided to relatively adjoin the temperature fuse is located higher than the other of the coupling projections with respect to the horizontal line.

9. The washing device as claimed in claim 8, wherein the temperature fuse is provided towards the terminal.

10. The washing device as claimed in claim 8, wherein the terminal is fixed to any one side of the case.

11. The washing device as claimed in claim 8, wherein the temperature fuse cuts off the power supplied to the heater when the heater is overheated.

12. The washing device as claimed in claim 8, wherein the coupling portion is respectively provided between one side of the main body of the laundry machine and any other side of the case and between an other side of the main body adjacent to the one side of the main body and a front or rear surface of the case.

13. The washing device as claimed in claim 8, wherein the coupling portion includes at least two coupling projections that respectively project from at least one side of the case as being elements of the case and couple with the main body of the washing device.

14. The washing device as claimed in claim 13, wherein the coupling projections coupled with the main body have ends downwardly slanted.

15. The washing device as claimed in claim 14, wherein the ends of the coupling projections are slanted at the same slant angle of the case.

16. The washing device as claimed in claim 15, wherein the coupling projections are respectively provided at different heights based on a horizontal direction.

17. The washing device as claimed in claim 16, wherein the coupling projections are respectively provided at opposite angles at the at least one side of the case.

18. The washing device as claimed in claim 8, wherein the coupling portion includes at least two coupling projections respectively projected from a front or rear surface of the case.

19. The washing device as claimed in claim 8, wherein the coupling portion includes at least one coupling projection respectively projected at one side of the case and coupled with one side of the main body, and at least another coupling projection respectively projected at a front or rear surface of the case as being elements of the case and coupled with another side of the main body adjacent to the one side of the main body.

* * * * *